US008528532B2

(12) United States Patent
Agneray et al.

(10) Patent No.: US 8,528,532 B2
(45) Date of Patent: Sep. 10, 2013

(54) OPTIMUM CONTROL OF THE RESONANT FREQUENCY OF A RESONATOR IN A RADIOFREQUENCY IGNITION SYSTEM

(75) Inventors: Andre Agneray, Boulogne Billancourt (FR); Julien Couillaud, Athis-mons (FR); Xavier Jaffrezic, Velizy-villacoublay (FR)

(73) Assignee: RENAULT s.a.s., Boulogne Billancourt (FR)

( * ) Notice: Subject to any disclaimer, the term of this patent is extended or adjusted under 35 U.S.C. 154(b) by 512 days.

(21) Appl. No.: 12/593,482

(22) PCT Filed: Feb. 12, 2008

(86) PCT No.: PCT/FR2008/050216

§ 371 (c)(1),
(2), (4) Date: Jan. 15, 2010

(87) PCT Pub. No.: WO2008/116991

PCT Pub. Date: Oct. 2, 2008

(65) Prior Publication Data

US 2010/0116257 A1 May 13, 2010

(30) Foreign Application Priority Data

Mar. 28, 2007 (FR) ..... 07 02275

(51) Int. Cl.
*F02P 3/01* (2006.01)
*F02P 23/00* (2006.01)
*F02B 19/00* (2006.01)

(52) U.S. Cl.
USPC ..... 123/606; 123/143 B

(58) Field of Classification Search
USPC ..... 123/606, 143, 143 B
See application file for complete search history.

(56) References Cited

U.S. PATENT DOCUMENTS 4,369,758 A * 1/1983 Endo ..... 123/620
5,179,928 A 1/1993 Cour et al.
5,361,737 A * 11/1994 Smith et al. ..... 123/143 B (Continued)

FOREIGN PATENT DOCUMENTS

| | | |
|---|---|---|
| FR | 2 649 759 | 1/1991 |
| FR | 2 859 831 | 3/2005 |
| WO | 2007 017481 | 2/2007 |
| WO | 2007 071865 | 6/2007 |

OTHER PUBLICATIONS

U.S. Appl. No. 12/096,382, filed Oct. 16, 2008, Agneray et al.
U.S. Appl. No. 13/057,349, filed Feb. 3, 2011, Agneray et al.

*Primary Examiner* — Stephen K Cronin
*Assistant Examiner* — Sherman Manley
(74) *Attorney, Agent, or Firm* — Oblon, Spivak, McClelland, Maier & Neustadt, L.L.P.

(57) ABSTRACT

A supply device for a radio frequency ignition system, including a supply circuit to provide a supply voltage to an output connected to a plasma generation resonator at a frequency defined by a control signal provided by a control device for the supply circuit. The control device includes a receiver interface for a determination request for the optimum control frequency, a receiver interface for receiving signals measuring the voltage at the pins of a capacitor in the supply circuit, a determination module for the optimum control frequency, to provide successive different control frequencies for the supply circuit for successive ignition commands on reception of a request and to determine an optimum control frequency based on received measured signals.

9 Claims, 2 Drawing Sheets

(56) References Cited

U.S. PATENT DOCUMENTS 5,587,630 A 12/1996 Dooley
5,949,193 A * 9/1999 Roine et al. ..... 315/111.51
6,913,006 B2 * 7/2005 Schleupen et al. ..... 123/606
2002/0043255 A1 * 4/2002 Kameda et al. ..... 123/606
2009/0165764 A1 7/2009 Agneray et al.
2009/0309499 A1 * 12/2009 Agneray et al. ..... 315/111.21

* cited by examiner

OPTIMUM CONTROL OF THE RESONANT FREQUENCY OF A RESONATOR IN A RADIOFREQUENCY IGNITION SYSTEM

BACKGROUND OF THE INVENTION

The present invention relates generally to the plasma-generation systems between two electrodes of a spark plug, used notably for the controlled radiofrequency ignition of a gas mixture in combustion chambers of an internal combustion engine.

For such a motor vehicle ignition application, with plasma generation, plasma-generating circuits incorporating plug coils are used to generate multi-filament discharges between their electrodes, to initiate the combustion of the mixture in the combustion chambers of the engine. The multi-spark plug referred to here is described in detail in the following patent applications filed in the name of the applicant: FR 03-10766, FR 03-10767 and FR 03-10768.

Referring to FIG. 1, such a plug coil is conventionally modeled by a resonator 1, the resonance frequency $F_c$ of which is greater than 1 MHz, and typically close to 5 MHz. The resonator, positioned at the plug level, comprises, in series, a resistor R, an inductor L and a capacitor C. Ignition electrodes 10 and 12 of the plug coil are connected to the terminals of the capacitor C.

When the resonator is powered by a high voltage at its resonance frequency $F_c \approx (1/2\pi\sqrt{(L \times C)})$, the amplitude at the terminals of the capacitor C is amplified, making it possible to develop multi-filament discharges between the electrodes of the plug, over distances of the order of a centimeter, at high pressure and for peak voltages less than 20 kV.

The sparks produced are then called "branched sparks", inasmuch as they involve the simultaneous generation of at least several ionization lines or paths in a given volume, their branchings also being omnidirectional.

This application to radiofrequency ignition entails the use of a power supply, capable of generating voltage pulses, typically of the order of 100 ns, that can reach amplitudes of the order of 1 kV, at a frequency very close to the resonance frequency of the radiofrequency resonator of the plug coil. The greater the difference between the resonance frequency of the resonator and the operating frequency of the power supply is reduced, the higher the overvoltage coefficient of the resonator (ratio between the amplitude of its output voltage and its input voltage) becomes.

FIGS. 2 and 2*a* schematically illustrate such power supplies. FIG. 2 is also detailed in the patent application FR 03-10767. The power supply conventionally uses a "class E power amplifier" configuration. This type of DC/AC converter can be used to create the voltage pulses with the above-mentioned characteristics.

According to the embodiment of FIG. 2, the power supply comprises a power supply circuit 2, respectively having a power MOSFET transistor M, used as a switch to control the switchings at the terminals of the plasma-generating resonator 1 intended to be connected to the output of the power supply circuit.

A control device 5 of the power supply circuit generates a control logic signal V1 and applies this signal to the gate of the power MOSFET transistor M, at a frequency which should be substantially aligned on the resonance frequency of the resonator 1.

The radiofrequency ignition system made up of the power supply circuit 2 and the resonator 1 is powered by a power supply voltage $V_{inter}$, designed to be applied by the switch M to an output of the power supply circuit, at the frequency defined by the control signal V1.

The power supply voltage $V_{inter}$ is more specifically supplied via a parallel resonant circuit 4, comprising an inductor Lp in parallel with a capacitor Cp, and connected between a capacitor Cb of the power supply circuit, charged at the power supply voltage $V_{inter}$, and the drain of the switch M. The capacitor Cb, charged at the power supply voltage $V_{inter}$, is used notably to stabilize the current on an ignition command.

FIG. 2*a* details a variant of the power supply of FIG. 2 with a transformer T, providing galvanic isolation to avoid the ground problems on the secondary, the inductor Lp then forming the primary of the transformer. This transformer has low gain of the order of 1.5 to 2.

Close to its resonance frequency, the parallel resonator 4 transforms the power supply voltage $V_{inter}$ into an amplified voltage Va, corresponding to the power supply voltage multiplied by the Q-factor of the parallel resonator. It is therefore the amplified power supply voltage Va which is applied to the output of the power supply circuit at the level of the drain of the switch transistor M.

The switch M then applies the amplified power supply voltage Va to the output of the power supply, at the frequency defined by the control signal V1, that should be made as close as possible to the resonance frequency of the plug coil. In practice, on an ignition command, in order to be able to set the radiofrequency ignition system to resonance mode and so maximize the transfer of energy to the resonator forming the plug coil, said plug coil must be controlled substantially at its resonance frequency.

SUMMARY OF THE INVENTION

The aim of the present invention is to determine this optimum resonance frequency of the radiofrequency plugcoil, in order to achieve optimum control at this resonance frequency of the plug coil.

The invention thus proposes a power supply device for a radiofrequency ignition system, comprising a power supply circuit configured to apply, to an output intended to be connected to a plasma-generating resonator, a power supply voltage at a frequency defined by a control signal supplied by a power supply circuit control device, characterized in that the control device comprises:

- an interface for receiving a request to determine an optimum control frequency,
- an interface for receiving signals measuring the voltage at the terminals of a capacitor of the power supply circuit,
- a module for determining the optimum control frequency, configured to supply, in succession, different control frequencies to the power supply circuit for successive ignition commands on reception of a request and to determine an optimum control frequency as a function of the measurement signals received via the reception interface.

Preferably, the module for determining the optimum control frequency is configured to determine an optimum control frequency that is substantially equal to the resonance frequency of the plasma-generating resonator.

According to one embodiment, the power supply circuit comprises a switch controlled by the control signal and connected to the output.

Preferably, the capacitor of the power supply circuit is charged at the power supply voltage at the beginning of each ignition command.

Advantageously, the module for determining the optimum control frequency is configured to compare two successive deviation values between a value of the voltage at the terminals of the capacitor of the power supply at the start of an ignition command and a value of the voltage at the terminals of the capacitor of the power supply at the end of an ignition command, to modify the control frequency in a first direction if the difference between the successive deviation values has a first sign and to determine that the preceding control frequency is the optimum control frequency if the difference between the successive values has a second sign.

The invention also relates to a radiofrequency ignition device comprising a power supply device as claimed in any one of the preceding claims, and a plasma-generating resonator connected to the output of the power supply device.

Advantageously, the plasma-generating resonator is suitable for ignition in one of the following implementations: controlled combustion engine ignition, ignition in a particulate filter, decontamination ignition in an air conditioning system.

BRIEF DESCRIPTION OF THE DRAWINGS

Other features and benefits of the present invention will become more clearly apparent from reading the following description, given by way of illustrative and nonlimiting example, and with reference to the appended figures in which.

DETAILED DESCRIPTION OF THE INVENTION

Figure 1:
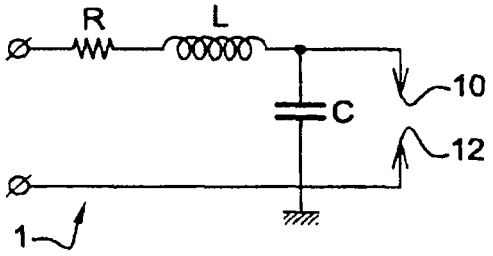
Fig. 1 BACKGROUND ART
FIG. 1 is a diagram of a resonator modeling a plasma-generating radiofrequency plug coil.
Figure 2:
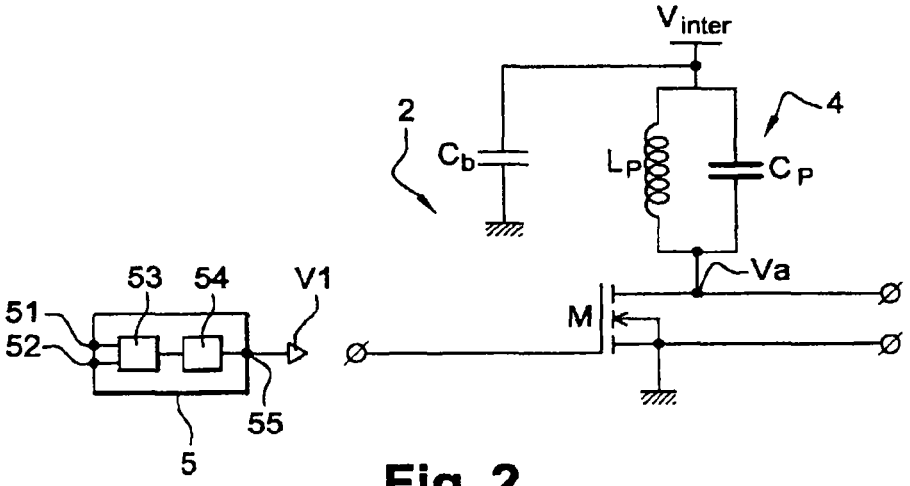
Fig. 2 BACKGROUND ART
FIG. 2 is a diagram illustrating a power supply, used to control the resonator of the plug coil of FIG. 1.
Figure 2A:
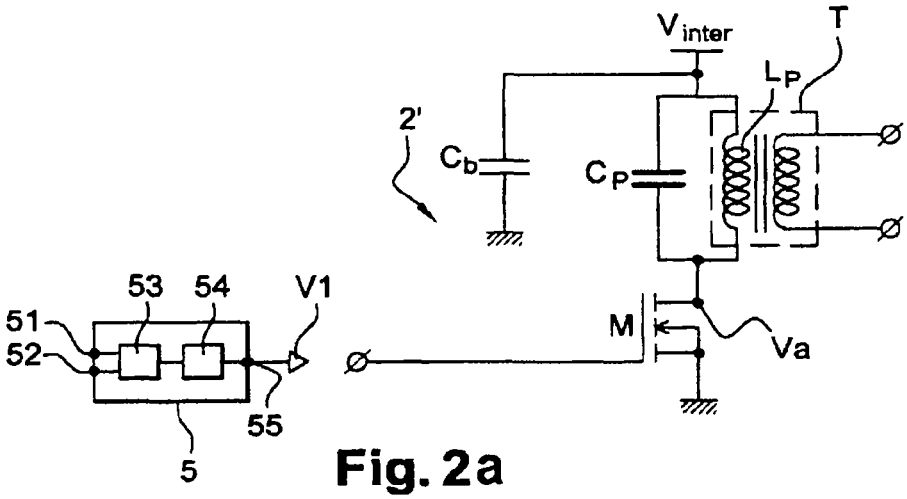
FIG. 2*a* is a variant of the power supply of FIG. 2.

As has been seen, for the ignition to be able to take place, it is necessary to determine an optimum control frequency for the control signal V1, controlling the switch M for the application of the high power supply voltage to the output of the power supply circuit to which the resonator 1 is connected. The optimum control frequency for the application of the power supply voltage to the plasma-generating resonator is a control frequency as close as possible to the resonance frequency of the resonator.

To achieve this, the control device 5 of the power supply comprises a module 53 for determining the optimum control frequency that is used, on reception of a request to determine an optimum control frequency on an interface 52 provided for this purpose, to determine and supply this optimum control frequency to a module 54, delivering the control signal V1 at the frequency determined on an output interface 55 of the control device to which the gate of the switch M is connected. The switch M then applies the high voltage, at the duly-defined frequency, to the output of the power supply circuit to which the plasma-generating resonator is connected.

There now follows a more detailed description of the process for determining the optimum control frequency applied by the control device, upon reception of a request to determine an optimum control frequency.

$T_{cb}(t)$ is taken to be the voltage at the terminals of the capacitor Cb as a function of time.

At the instant t=0, the control signal V1 is applied to the control gate of the switch M, thus making it possible to apply the high voltage to the terminals of the resonator of the plug coil, at the frequency defined by the control signal V1.

At the instant t=D, following the application of the high voltage to the terminals of the resonator of the plug coil for a duration D, the spark is produced between the electrodes of the plug coil.

Upon such an ignition command, the radiofrequency resonator of the plug coil is driven at its resonance frequency if, and only if, the deviation, denoted $\Delta T_{cb}$, between the value of the voltage at the terminals of the capacitor Cb of the power supply circuit at the start of ignition, denoted Tcb(0) (i.e. at the instant t=0, when the control signal V1 is applied to the control gate of the switch M) and at the end of ignition, denoted Tcb(D) (i.e. after a duration D of application of the control signal V1 at the end of which the spark is produced between the electrodes of the plug) is maximum. Preferably, the above-mentioned voltage values used for calculating $\Delta T_{cb}$ are squared.

In other words, the radiofrequency plasma-generating resonator 1 is driven at its resonance frequency if and only if:

$$\Delta T_{cb}=([Tcb(0)]^2-[Tcb(D)]^2) \text{ is a maximum.}$$

Therefore, the module 53 for determining the optimum control frequency, upon successive ignitions, takes an electrical measurement of the voltage at the terminals of the capacitor Cb of the power supply at the start of ignition and at the end of ignition, via an interface 51 for receiving such measurement signals.

These electrical measurements of the value of the voltage at the terminals of the capacitor Cb at the start and at the end of ignition upon successive ignitions will then be used, on the basis of the principles explained above and as will be seen in more detail below, to determine an optimum control frequency for driving the plasma-generating resonator, corresponding substantially to the resonance frequency of the resonator. The optimum control frequency is then stored, then used as the control frequency for the switch M, in a normal operating phase of the radiofrequency ignition device, during which a plasma must be generated between the electrodes of the plug coil.

The plasma-generating device can include a plasma-generating resonator suitable for performing a controlled ignition of the combustion engine, suitable for performing an ignition in a particulate filter or suitable for performing a decontamination ignition in an air conditioning system.

Figure 3:
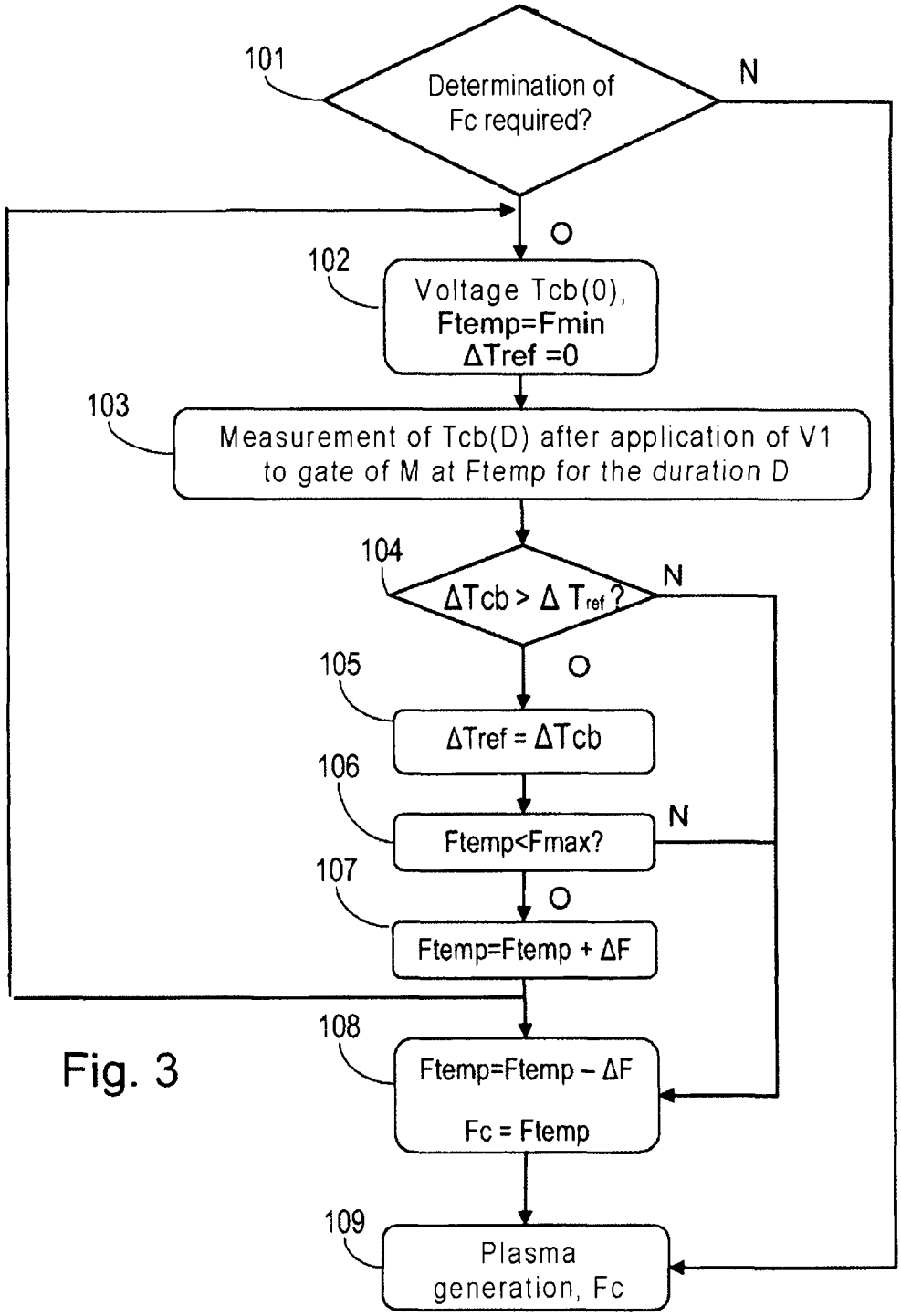
FIG. 3 is an exemplary algorithm for determining the resonance frequency of the plug coil.

FIG. 3 illustrates an exemplary algorithm for determining an optimum control frequency corresponding to the resonance frequency of the resonator.

In a step 101, a check is carried out to ensure that a request to determine the resonance frequency $F_c$ of the resonator has been received.

In the absence of such a request, the algorithm goes on to the step 109 and a plasma is generated by the resonator 1 by using the optimum control frequency to apply the high voltage to the resonator 1 via the switch M. The switch M is then controlled to apply to the resonator 1 an adequate voltage to generate a plasma, in a manner that is known per se.

In the presence of a request to find the resonance frequency, the capacitor Cb of the power supply is charged at the voltage $T_{cb}(\mathbf{0})$ designed to be applied via the switch M to the resonator 1 in the step 102 to command an ignition. This voltage is applied at a predetermined control frequency Ftemp, for example chosen to be equal to Fmin, corresponding to the minimum control frequency of the radiofrequency plasma-generating resonator.

In the step 103, a measurement $T_{cb}(D)$ is taken of the voltage at the terminals of the capacitor Cb of the power supply after a duration D of application of the control signal V1 to the control gate of the switch M at the frequency Ftemp.

In the step 104, from the measurement signals $T_{cb}(0)$ and $T_{cb}(D)$ received over the reception interface, the deviation $\Delta T_{cb}$ between the square of the voltage at the terminals of the capacitor Cb at the start of ignition $T_{cb}(0)$ and the square of the voltage at the terminals of the capacitor Cb at the end of ignition $T_{cb}(D)$, is calculated and compared to a reference ΔTref, the initial value of which is chosen, for example, to be equal to 0 in an initialization phase for this reference executed in the step 102.

If the calculated deviation $\Delta T_{cb}$ exceeds the reference ΔTref, the reference ΔTref is first updated with the value $\Delta T_{cb}$ previously calculated in the step 105.

A check is also carried out in the step 106 to ensure that the current value of the control frequency Ftemp is less than Fmax, corresponding to the maximum control frequency of the radiofrequency plasma-generating resonator. If the value Ftemp does not exceed Fmax, the value of the control frequency Ftemp is increased by a certain frequency step ΔF in the step 107.

For more details concerning the calculation of the frequency step used to increase the current value of the control frequency, the reader is urged to refer to the content of the French patent application 05 12769, filed in the name of the applicant.

The steps 102 to 104 are then repeated with the new values of Ftemp and ΔTref.

When, in the step 104, it has been determined that the deviation $\Delta T_{cb}$ is less than the reference ΔTref, it is determined that the optimum control frequency of the resonator was the preceding control frequency. In the step 108, the control frequency is updated with its preceding value and the optimum control frequency of the resonator is set at this value, then substantially corresponding to the value of the resonance frequency F, of the plasma-generating resonator.

The optimum control frequency $F_c$ determined in this way can then be used for the plasma generation in the step 109.

The algorithm that has just been described, applied by the module 53 of the control device 5, can then be used to obtain an optimum control at resonance frequency of the plasma-generating resonator.

The invention claimed is:

1. A power supply device for a radiofrequency ignition system, comprising:

a power supply circuit configured to apply, to an output to be connected to a plasma-generating resonator, a power supply voltage at a frequency defined by a control signal supplied by a power supply circuit control device, the power supply circuit comprising a parallel resonant circuit connected between a capacitor of the power supply circuit and a drain of a switch transistor controlled by the control signal and connected to the output;

the power supply circuit control device includes a first interface configured to receive a request to determine an optimum control frequency;

the power supply circuit control device includes a second interface configured to receive signals measuring voltage at terminals of the capacitor of the power supply circuit; and a module configured to determine optimum control frequency, configured to supply, in succession, different control frequencies to the power supply circuit for successive ignition commands on reception of a request and to determine an optimum control frequency as a function of measurement signals received via the second interface.

2. The device as claimed in claim 1, wherein the module that determines the optimum control frequency is configured to determine an optimum control frequency that is substantially equal to the resonance frequency of the plasma-generating resonator.

3. The device as claimed in claim 1, wherein the capacitor of the power supply circuit is charged at the power supply voltage at a beginning of each ignition command.

4. The device as claimed in claim 1, wherein the module that determines the optimum control frequency is configured to compare two successive deviation values between a value of the voltage at the terminals of the capacitor of the power supply at a start of an ignition command and a value of the voltage at the terminals of the capacitor of the power supply at an end of the ignition command, to modify the control frequency in a first direction if the difference between the successive deviation values has a first sign and to determine that the preceding control frequency is the optimum control frequency if the difference between the successive values has a second sign.

5. A radiofrequency ignition device comprising:

a power supply device as claimed in claim 1; and a plasma-generating resonator connected to the output of the power supply device.

6. The radiofrequency ignition device as claimed in claim 5, in which the plasma-generating resonator is suitable for ignition in one of following implementations: controlled combustion engine ignition; ignition in a particulate filter; or decontamination ignition in an air conditioning system.

7. The device as claimed in claim 1, wherein the parallel resonant circuit includes a second capacitor in parallel with an inductor.

8. The device as claimed in claim 1, wherein the power supply circuit control device includes the first interface, the second interface, and the module that determines the optimum control frequency.

9. The device as claimed in claim 1, wherein the parallel resonant circuit is directly connected to the drain of the switch transistor.

* * * * *